US008142131B2

(12) United States Patent
Tygard

(10) Patent No.: US 8,142,131 B2
(45) **Date of Patent: *Mar. 27, 2012**

(54) CLAMPING APPARATUS

(75) Inventor: Edward Tygard, McMurray, PA (US)

(73) Assignee: Tygard Machine & Manufacturing Company, Washington, PA (US)

( * ) Notice: Subject to any disclaimer, the term of this patent is extended or adjusted under 35 U.S.C. 154(b) by 26 days.

This patent is subject to a terminal disclaimer.

(21) Appl. No.: 12/453,441

(22) Filed: May 11, 2009

(65) Prior Publication Data

US 2010/0117390 A1 May 13, 2010

Related U.S. Application Data

(63) Continuation of application No. 10/689,848, filed on Oct. 22, 2003, now Pat. No. 7,537,427.

(60) Provisional application No. 60/430,675, filed on Dec. 4, 2002, provisional application No. 60/469,416, filed on May 12, 2003.

(51) Int. Cl.
*B66F 9/18* (2006.01)

(52) U.S. Cl. ..... 414/623; 294/81.51; 414/621; 414/733; 414/931

(58) Field of Classification Search ..... 414/620, 414/621, 623, 712, 716, 733, 739, 790.2, 414/796.2, 796.9, 917, 931; 294/81.51
See application file for complete search history.

(56) References Cited

U.S. PATENT DOCUMENTS

| | | | | |
|---|---|---|---|---|
| 2,348,899 | A | 5/1944 | Guignard et al. | 214/131 |
| 3,044,819 | A | 7/1962 | Pierre | 294/88 |
| 3,195,248 | A | 7/1965 | Martin | 37/124 |
| 3,291,330 | A | 12/1966 | Wagner | 214/775 |
| 3,549,192 | A | 12/1970 | Cassady | 294/106 |
| 3,796,332 | A | 3/1974 | Kawamura | 214/147 G |
| 4,019,588 | A | 4/1977 | Casey | 172/804 |
| 4,252,496 | A | 2/1981 | Williams | 414/623 |
| 4,303,269 | A | 12/1981 | Faughnan | 294/86 R |
| 4,422,818 | A | 12/1983 | Molby | 414/712 |
| 4,456,293 | A | 6/1984 | Panissidi | 294/106 |
| 4,603,896 | A | 8/1986 | Vasseur et al. | 294/2 |
| 5,161,934 | A | 11/1992 | Richardson | 414/621 |
| 5,192,179 | A | 3/1993 | Kovacs | 414/710 |
| 5,253,974 | A | 10/1993 | Williams | 414/623 |
| 5,516,255 | A | 5/1996 | Tygard | 414/607 |
| 6,135,704 | A | 10/2000 | Seaberg | 414/791.6 |

OTHER PUBLICATIONS

"Drawing of Roller Clamp" showing a clamping apparatus sold by Tygard Machine and Manufacturing Company in Apr. 2000.

*Primary Examiner* — James Keenan

(74) *Attorney, Agent, or Firm* — Michael Tobias

(57) ABSTRACT

A clamping apparatus includes a frame and a pair of opposing clamping arms mounted on the frame for movement towards and away from each other to grasp or release a load. In one embodiment, each clamping arm is guided for movement with respect to the frame by an adjustable bushing which can be rotated to adjust the position of the bushing with respect to the clamping arm. In another embodiment, each clamping arm defines a four-bar linkage which controls the angle with respect to the vertical of a contact portion of the clamping arm. The clamping apparatus may be mounted on a lift truck or other support member by a connector which permits the angle of the clamping apparatus with respect to the horizontal to be adjusted and which enables the clamping apparatus to pivot about an axis between a position in which it is disposed outboard of the axis and a position in which is it disposed forward of the axis.

4 Claims, 11 Drawing Sheets

CLAMPING APPARATUS

REFERENCE TO RELATED APPLICATIONS

This application is a continuation of U.S. patent application Ser. No. 10/689,848 filed on Oct. 22, 2003 now U.S. Pat. No. 7,537,427, the disclosure of which is incorporated by reference, which claims the benefit of U.S. Provisional Application No. 60/430,675 filed on Dec. 4, 2002 and U.S. Provisional Application No. 60/469,416 filed on May 12, 2003, the disclosures of which are incorporated by reference.

BACKGROUND OF THE INVENTION

1. Field of the Invention

This invention relates to a clamping apparatus for use in releasably grasping a load to be lifted from two or more sides. It also relates to an adjustable bushing suitable for slidably supporting a translating member, such as a clamping arm of a clamping apparatus.

2. Description of the Related Art

Various clamping apparatuses have been developed for use in lifting loads. Among these clamping apparatuses are ones having a plurality of clamping arms which can releasably grasp a load to be lifted from multiple sides. In some cases, the clamping arms pivot between an open and closed position. In other cases, the clamping arms translate without pivoting along a linear or other path between an open and closed position.

With a clamping apparatus of the type in which clamping arms translate without pivoting, bearings for supporting the clamping arms can wear out over time, and when such wear occurs, it is difficult to guide the clamping arms in a stable manner.

With a clamping apparatus of the type in which the clamping arms pivot between an open and closed position, the angle with respect to the vertical of the contact portions of the clamping arms which contact a load to be lifted may vary significantly as the clamping arms pivot. Therefore, when the clamping apparatus is used to grasp loads having different dimensions, it is difficult to maintain a suitable angle of the contact portions for all of the loads.

SUMMARY OF THE INVENTION

The present invention provides a clamping apparatus having improved operability for grasping a load from multiple sides.

The present invention additionally provides a connector for use in connecting a clamping apparatus to a lift truck or other support member.

The present invention also provides a bushing arrangement for slidably guiding a translating member, such as a clamping arm of a clamping apparatus.

A clamping apparatus according to the present invention will typically have at least two clamping arms so as to be able to releasably grasp a load from two or more sides. In preferred embodiments the clamping apparatus has four clamping arms for grasping a load from four sides. The clamping apparatus may be used to grasp a single item, or it may be used to simultaneously grasp a plurality of items. For example, the clamping apparatus may be used to grasp a single box, or it may be used to grasp one or more layers off a pallet, each layer comprising a plurality of boxes or other items. The clamping apparatus is typically mounted on a lift truck (such as a forklift) or other lifting device which can maneuver the clamping apparatus while the clamping apparatus is grasping a load, but it may be mounted on any other type of device or member.

When the clamping apparatus is intended for use in grasping a four-sided load, it will typically have an even number of clamping arms, such as two or four clamping arms arranged in opposing pairs. However, the number of clamping arms and their orientation with respect to each other is not restricted. For example, if the clamping apparatus is intended for use in grasping a round load such as a barrel, it may have an odd number of clamping arms, such as three.

The clamping arms are supported for rotational or translational movement relative to each other by a frame. In preferred embodiments, the frame has the shape of a cross, but numerous other shapes are possible, such as polygonal shapes (squares, rectangles, triangles, etc.) or curved shapes (circles, ellipses, etc.).

DESCRIPTION OF PREFERRED EMBODIMENTS

Figure 1:
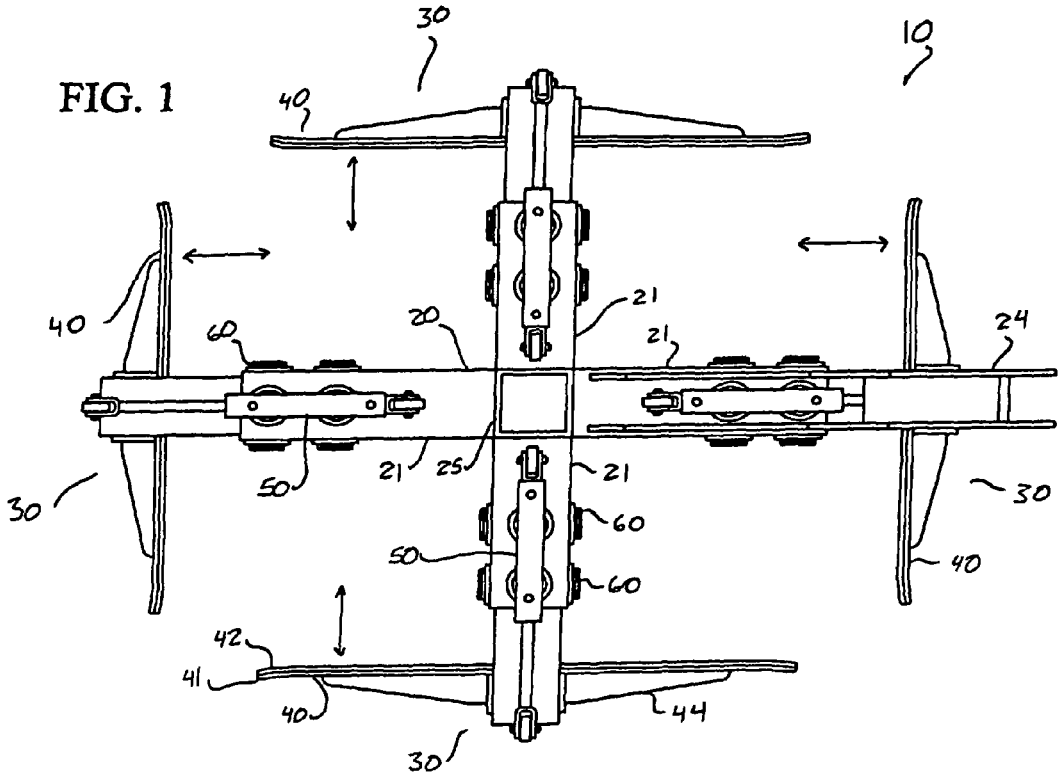
FIG. 1 is a plan view of an embodiment of a clamping apparatus according to the present invention having clamping arms which translate with respect to each other without pivoting.
Figure 2:
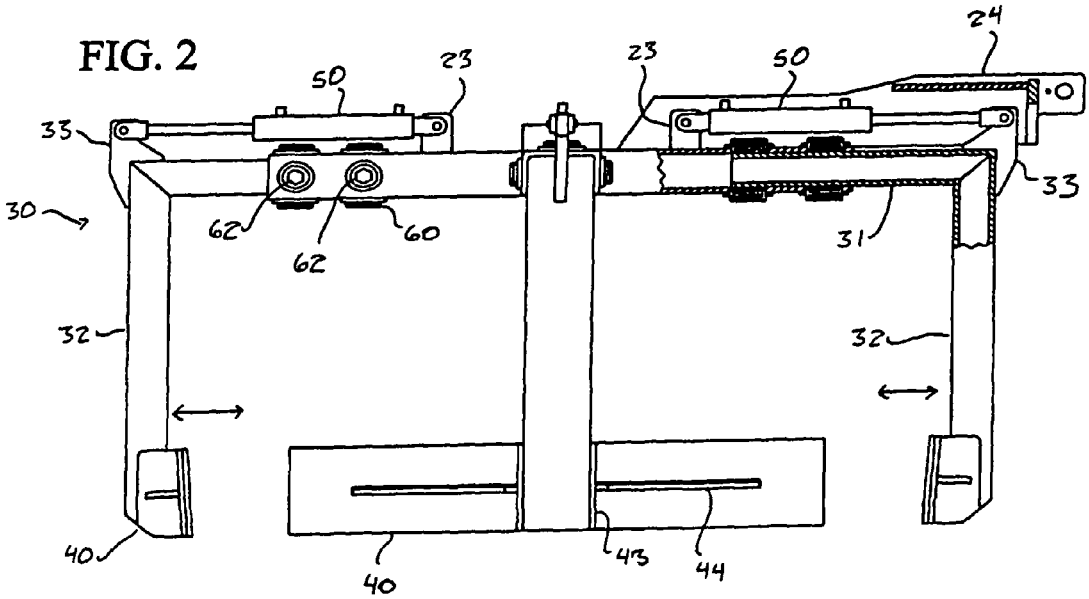
FIG. 2 is a cutaway elevation of the embodiment of FIG. 1.
Figure 3:
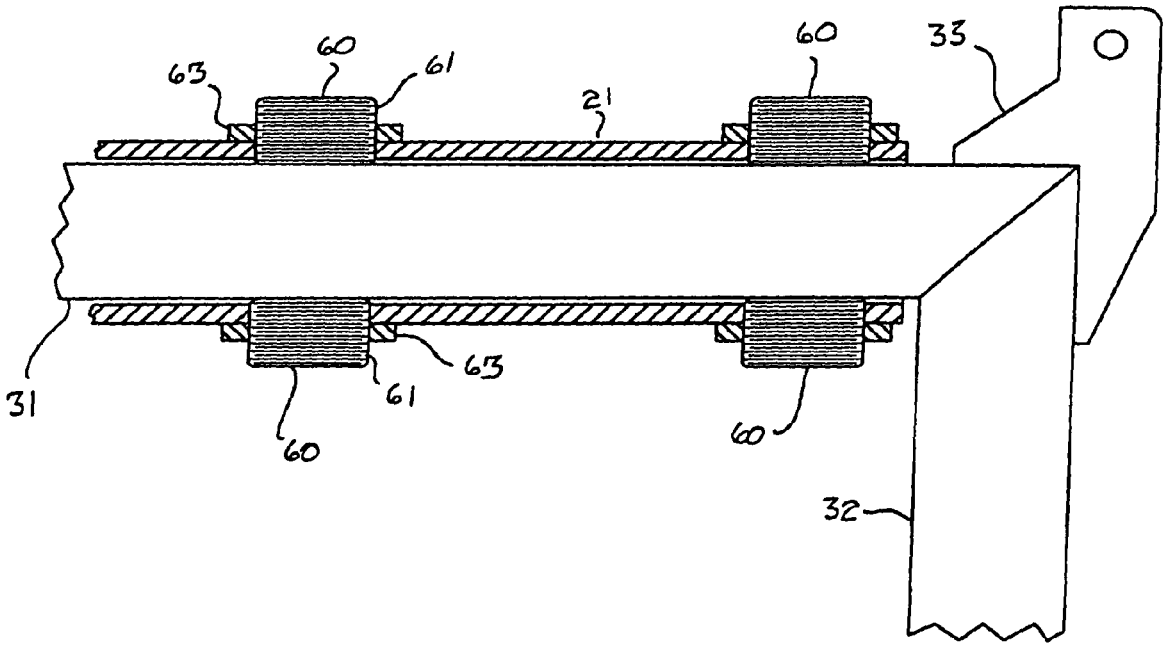
FIG. 3 is an enlarged partially cross-sectional elevation of the outer end of one of the legs of the frame of the embodiment of FIG. 1.

FIGS. 1-3 illustrate a first embodiment of a clamping apparatus 10 according to the present invention. This embodiment includes a frame 20 supporting a plurality of clamping arms 30 so as to enable opposing clamping arms 30 to translate with respect to each other to grasp or release a load. The frame 20 need not have any particular shape. In the present embodiment, the frame 20 is cross-shaped and has four tubular legs 21 disposed at right angles to each other. The inner end of each leg 21 is connected to a vertically extending rectangular guide tube 25 at the center of the frame 20. The guide tube 25 can be used to slidably receive an unillustrated internal support member for reinforcing the inner walls of a cavity in a layer of objects to be lifted by the clamping apparatus 10, as described in U.S. Pat. No. 6,003,917. However, if a support member is not needed, the guide tube 25 can be omitted, and the legs 21 can be directly connected to each other at their inner ends. The frame 20 may be equipped with a mounting bracket 24 or other suitable structure for mounting the clamping apparatus 10 on a lift truck or other device.

Each leg 21 of the frame 20 supports one of the clamping arms 30 for linear movement in the lengthwise direction of the leg 21. Each clamping arm 30 has a first leg 31 extending substantially horizontally and received in the outer end of one of the legs 21 of the frame 20 and a second leg 32 extending downwards from the outer end of the first leg 31. Each of the first legs 31 can translate in its lengthwise direction inside the corresponding leg 21 of the frame 20 to enable the clamping arms 30 to move in and out of the frame 20 towards and away from each other to enable the spacing between opposing clamping arms 30 to be adjusted.

In the present embodiment, the legs 21 of the frame 20 and the first legs 31 of the clamping arms 30 are tubes having a polygonal (e.g., square or rectangular) transverse cross section, but the legs 21 and 31 are not restricted to any particular cross-sectional shape. For example, they could be non-polygonal tubes, such as tubes of circular or elliptical cross section, and they need not be tubular. For example, the first legs 31 of the clamping arms 30 may comprise rods, plates, or beams of various shapes.

Each clamping arm 30 includes a contact portion 40 at the lower end of the second leg 32 for contacting a side of a load to be lifted by the clamping apparatus 10. The illustrated contact portion 40 comprises a rigid panel 41 secured to the second leg 32, and it may include a resilient pad 42 of rubber or other resilient material mounted on the inner surface of the panel 41 to cushion a load being lifted and prevent scratches as well as to provide a non-skid surface having a good grip. The panel 41 can be secured to the second leg 32 in any convenient manner, such as by a pair of mounting lugs 43 secured to the rear side of the panel 41. The contact portion 40 may also be equipped with stiffeners 44 for reinforcing the panel 41. The shape of the contact portion 40 may be selected in accordance with the shape of the load which is to be grasped by the clamping apparatus 10. For example, if the clamping apparatus 10 is intended primarily to grasp a rectangular layer of boxes, the inner surface of the contact portions 40 may be substantially planar over much of its length, while if the clamping apparatus 10 is intended to grasp curved objects such as barrels, the inner surface of the contact portions 40 may be curved to match the shape of the curved objects. As shown in FIG. 1, the outer ends of the inner surface may be flared away from the center of the clamping apparatus 10 to prevent the ends from pinching the corners of a load being grasped.

Drive mechanisms for translating opposing clamping arms 30 towards and away from each other are connected between the frame 20 and the clamping arms 30. The illustrated drive mechanisms comprise hydraulic cylinders 50, but electric motors, hydraulic motors, pneumatic cylinders, and other mechanisms may also be employed, with the drive mechanisms either connected directly to the clamping arms 30 or through an intermediate motion converting mechanism such as a lead screw mechanism. A separate hydraulic cylinder 50 is shown provided for each clamping arm 30, but alternatively, two opposing clamping arms 30 may share a common drive mechanism, or more than one drive mechanism may be provided for each clamping arm 30. Each hydraulic cylinder 50 has one of its ends connected to a mounting bracket 23 secured to one of the legs 21 of the frame 20 and its other end connected to a mounting bracket 33 secured to one of the clamping arms 30.

While the illustrated embodiment includes four clamping arms 30, a different number, such as two, may be employed. All of the illustrated clamping arms 30 are capable of translating with respect to the frame 20, but it is also possible for one or more of the clamping arms 30 to be stationary with respect to the frame 20 while the opposing clamping arm 30 can translate.

Each leg 21 of the frame 20 is equipped with one or more adjustable bushings 60 for supporting the first leg 31 of the corresponding clamping arm 30 for sliding movement inside the frame 20. Each bushing 60 has external threads 61 by means of which the bushing 60 can be screwed into a threaded hole in one of the legs 21 of the frame 20. Alternatively, threads may be formed on other members instead of directly on the legs 21 of the frame 20 or the bushings 60. For example, a bushing 60 could screw into an internally threaded sleeve or nut secured to a side of a leg 21 of the frame 20, or a bushing 60 could be housed in an externally threaded sleeve which screws into a leg 21 of the frame 20 or a member secured to the leg 21. The bushing 60 may be provided with a portion which can be engaged by a wrench, a screwdriver, or other tool to facilitate rotation of the bushing 60 with respect to the leg of the frame 20. In this embodiment, the outer end of each bushing 60 is formed with a socket 62 for receiving an Allen wrench. A lock nut 63 may be provided on each bushing 60 to secure the bushing 60 in place on the frame 20.

At least the inner end of each bushing 60 is preferably made of a material having good sliding properties. A wide variety of materials can be used to form the bushings 60. Some examples of suitable plastics which can be employed are nylon, polyethylene (such as ultra-high molecular weight polyethylene), polyesters, Teflon, and acetals. An example of a suitable metal which can be employed is oil-impregnated bronze. The illustrated bushing 60 is formed entirely of Nyloil, which is a trademark of Cast Nylons Limited of Willoughby, Ohio for cast oil-filled Nylon-6.

The number of bushings 60 is not restricted. In the illustrated embodiment, each leg 21 of the frame 20 is equipped with eight bushings 60, with four bushings 60 being disposed in a first location and a second location spaced along the length of the leg 21 from the first location on all four sides of the leg, i.e., on the top, bottom, and both lateral sides. Depending upon the loads applied to the clamping arms 30, the bushings 60 may be mounted on fewer than all four sides of each leg 21. For example, bushings 60 may be mounted on only the top and bottom sides of a leg 21 if there are no substantial lateral loads applied to a clamping arm 30.

The positions of the inner ends of the bushings 60 can be adjusted by rotating the bushings 60 in the corresponding holes in the legs 21 of the frame 20 so that there is a desired contact pressure or clearance between the bushings 60 and the first legs 31 of each clamping arm 30 to allow smooth sliding movement of the clamping arms 30. In the present example, the inner end of each bushing 60 is in sliding contact with the first leg 31 of the corresponding clamping arm 30 to minimize play when the clamping arm 30 is translating in the lengthwise direction of the leg 21 of the frame 20. When the bushings 60 become worn through use, the positions of the inner ends of the bushings 60 can be readjusted. If a bushing 60 becomes too worn, it can be easily removed from the frame 20 and replaced with a new one. Thus, the adjustable bushings 60 allow smooth operation of the clamping apparatus 10 over long periods.

The clamping apparatus 10 can be used in a manner well-known in the art to grasp a load from a plurality of sides to enable the load to be lifted. For example, the apparatus 10 can be used to lift one or more layers of objects off a pallet without the need to lift the pallet itself. The clamping apparatus 10 can be conveniently mounted on a lift truck, but it can be supported during use by any other convenient device.

The adjustable bushings 60 are not restricted to use in guiding clamping arms 30 of a clamping apparatus and can be used to guide other sliding members.

Figure 5:
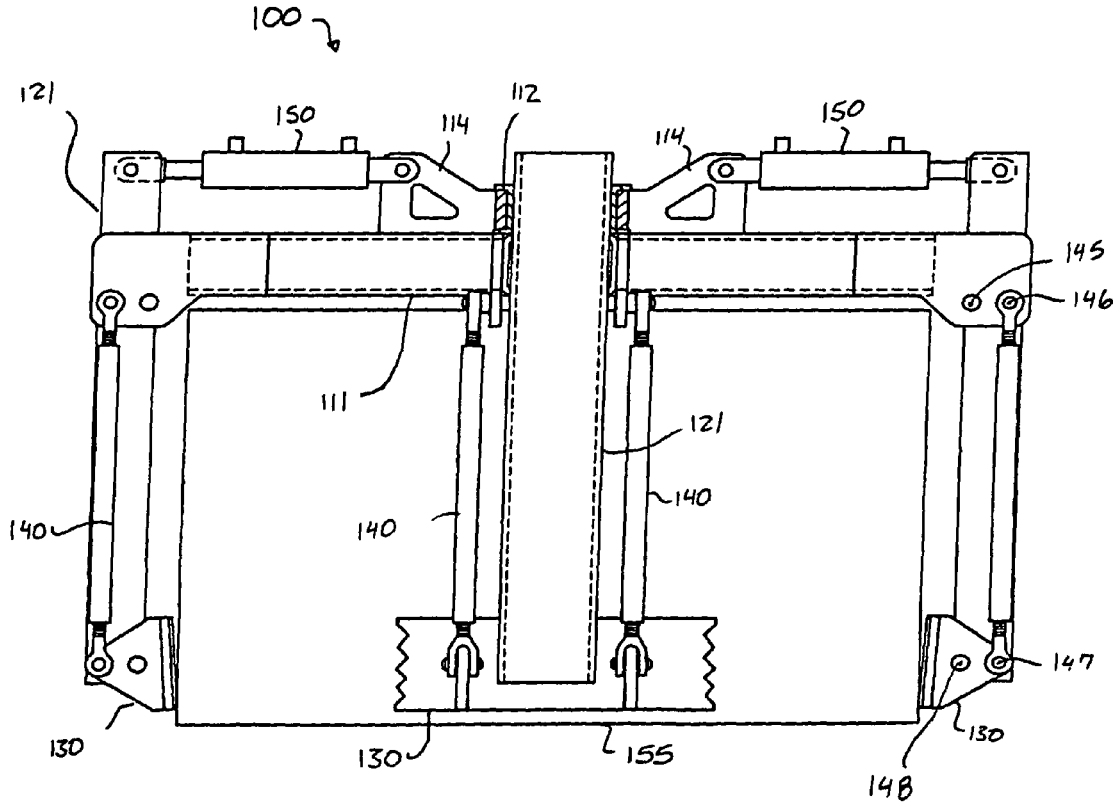
FIG. 5 is an elevation of the embodiment of FIG. 4 with the opposing clamping arms of the apparatus separated by a second spacing smaller than the first spacing.
Figure 6:
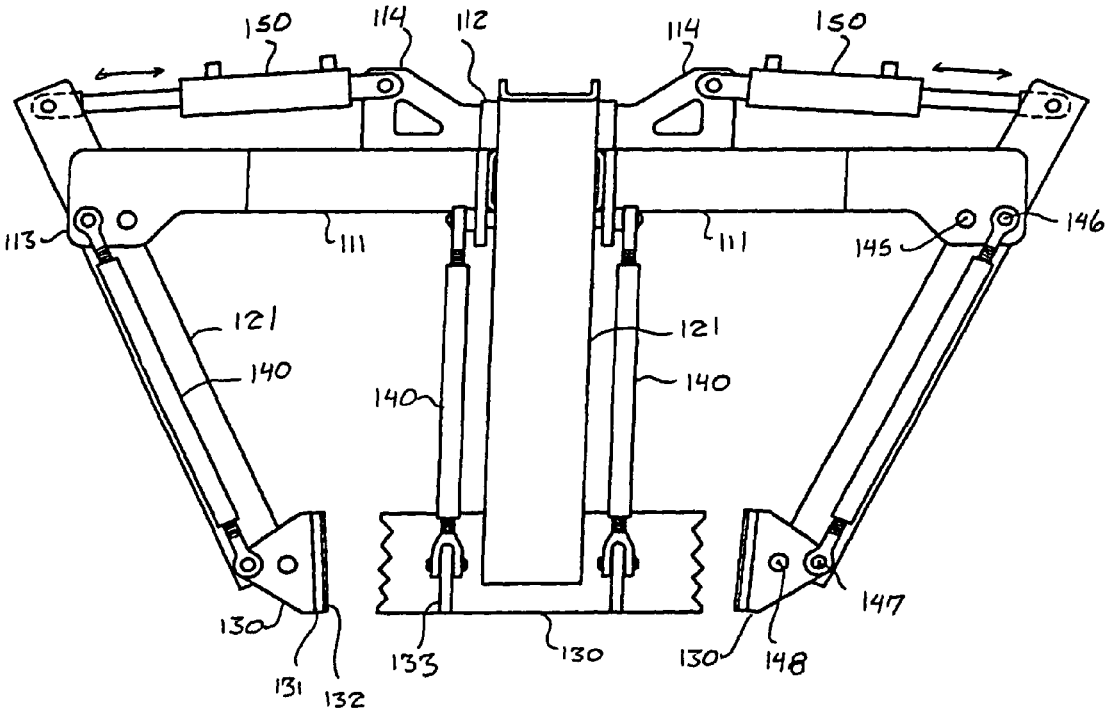
FIG. 6 is an elevation of the embodiment of FIG. 4 with the opposing clamping arms of the apparatus separated by a third spacing smaller than the second spacing.
Figure 7:
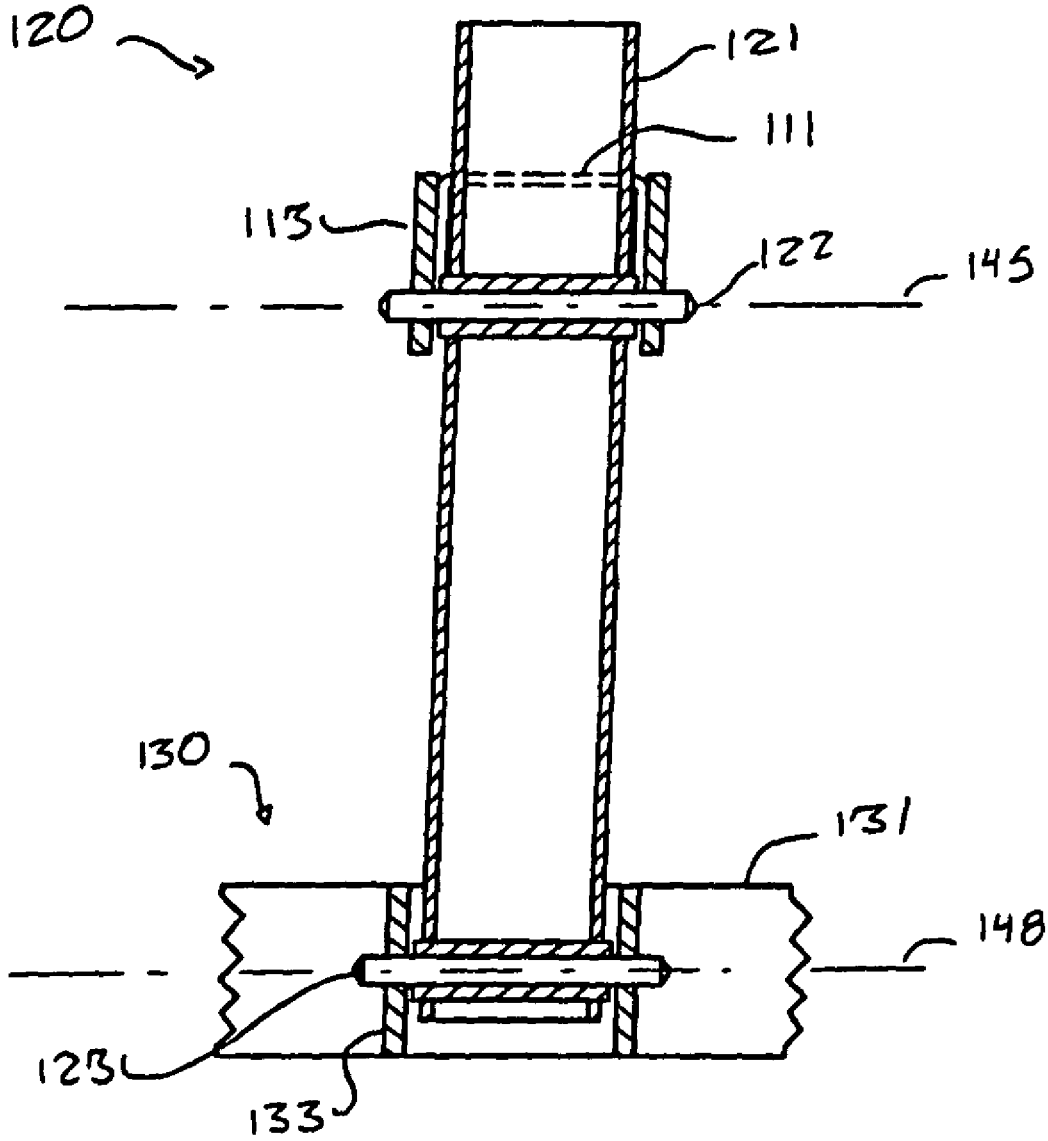
FIG. 7 is a cross-sectional elevation of one of the clamping arms of the embodiment of FIG. 4 with the control rods omitted for clarity.
Figure 8:
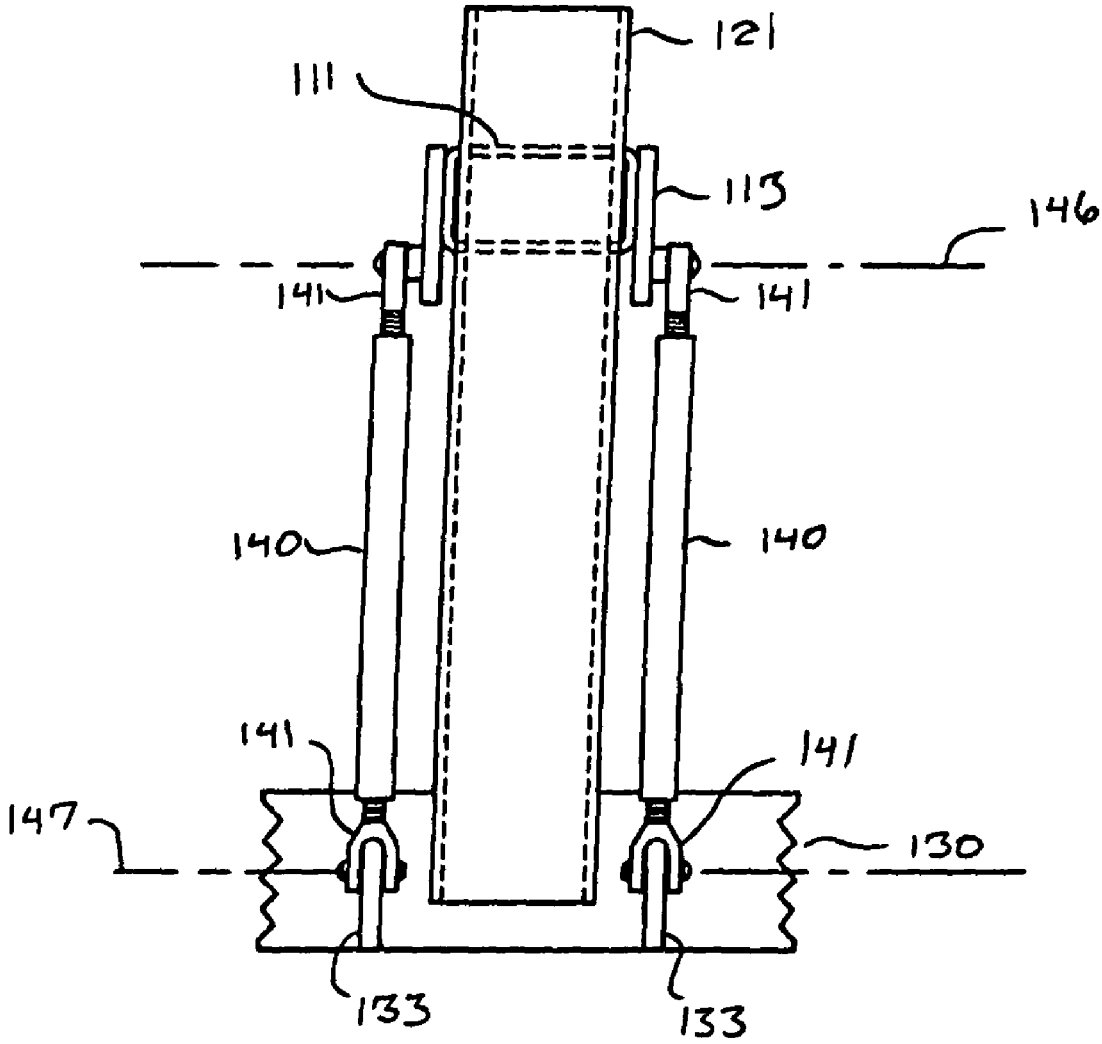
FIG. 8 is an elevation of one of the clamping arms of the embodiment of FIG. 4 with the connections of the lever portion of the clamping arm to the frame and to the contact portion omitted for clarity.

FIGS. 4-7 illustrate another embodiment of a clamping apparatus 100 according to the present invention. Like the previous embodiment, this embodiment includes a cross-shaped frame 110 having four horizontally extending legs 111. However, as explained with respect to the preceding embodiment, the frame 110 is not restricted to any particular shape and need not be cross-shaped. Only two of the legs 111 are clearly visible in the drawings, but two more legs 111 extend perpendicular to the plane of the drawings at right angles to the first two legs 111. The inner end of each leg 111 is shown connected to a vertically extending rectangular guide tube 112 corresponding to the guide tube 25 of the embodiment of FIG. 1. However, as in that embodiment, the guide tube 112 may be omitted, and the legs 111 can be directly connected to each other at their inner ends. Each of the illustrated legs 111 includes a rectangular tube and a pair of mounting plates 113 secured to opposite lateral sides of the tube at the outer of the leg 111. A clamping arm 120 is pivotably mounted on the mounting plates 113 of each leg 111 of the frame 110. Each clamping arm 120 includes one or more generally upright, elongated lever portion 121 and a contact portion 130 mounted on the lower end of the lever portion 121. As shown in FIG. 7, each lever portion 121 comprises a channel pivotably mounted near its upper end on an axle 122 supported by the mounting plates of the corresponding leg 111 of the frame 110. In the present embodiment, each axle 122 is the same distance from the center of the frame 110, but it is possible for this distance to vary among the axles 122. One or more drive mechanisms, such as hydraulic cylinders 150, are provided for pivoting the lever portions 121 about the axles 122. In the illustrated embodiment, a separate hydraulic cylinder 150 is provided for each clamping arm 120, with one end of the hydraulic cylinder 150 being pivotably connected to a bracket 114 on the frame 110 and the opposite end being pivotably connected to one of the lever portions 121 near its upper end. When the hydraulic cylinders 150 are actuated, the lever portions 121 can pivot to adjust the separation between the contact portions 130 to enable them to grasp or release a load. As is the case with respect to the previous embodiment, drive mechanisms other than hydraulic cylinders 150 can be employed to pivot the lever portions 121, such as electric motors, hydraulic motors, or pneumatic cylinders. The hydraulic cylinders 150 exert a linear drive force on the lever portions 121 to pivot the clamping arms 120, but a drive mechanism which exerts a rotational drive force can also be used.

The contact portions 130 may have a structure similar to the contact portions of the previous embodiment. Each contact portion 130 includes an elongated rigid panel 131 and a resilient pad 132 of rubber or similar material on the inner surface of the panel 131 to provide cushioning and a good grip. A plurality of mounting lugs 133 are mounted on the outer surface of each panel 131. As shown in FIG. 7, the lower end of each lever portion 121 is pivotably mounted on an axle 123 extending between two of the lugs 133 to provide a pivotable connection between the lever portion 121 and the contact portion 130.

Each clamping arm 120 also includes one or more control rods 140 extending alongside, such as parallel to, the lever portion 121. The load applied to the control rods 140 will typically be less than that applied to the lever portions 121, since in this embodiment a bending moment is applied by the hydraulic cylinders 150 only to the lever portions 121, so the control rods 140 can generally be of lighter construction than the lever portions 121. Each control rod 140 is preferably sufficiently stiff to prevent the contact portion 130 from rotating about the lower end of the lever portion 121 under forces applied to the contact portion 130 when it is pressed against the side of a load which is to be grasped by the clamping apparatus 100. The upper end of each control rod 140 is pivotably connected to one of the mounting plates 113 of a leg 111 of the frame 110, and the lower end of each control rod 140 is pivotably connected to one of the mounting lugs 133 on the contact portion 130. When any of the clamping arms 120 is viewed from the side, such as in FIG. 4, the axis of rotation 145 of the lever portion 121 with respect to the frame 110, the axis of rotation 146 of the upper end of the control rods 140 with respect to the frame 110, the axis of rotation 147 of the lower ends of the control rods 140 with respect to the mounting lugs 133 of the contact portion 130, and the axis of rotation 148 of the lower end of the lever portion 121 with respect to the mounting lugs 133 of the contact portion 130 lie at the four corners of a quadrilateral. As a result, the lever portion 121, the control rods 140, the mounting plates 113 of the frame 110, and the mounting lugs 133 of the contact portion 130 define a four-bar linkage. The four-bar linkage functions to control the angle of the inner surface of the contact portion 130 with respect to the vertical as the lever portion 121 of the clamping arm 120 pivots about its upper end. If the quadrilateral is a parallelogram, the four-bar linkage becomes a parallel linkage, and the angle of the inner surface of the contact portion 130 with respect to the vertical remains constant as the lever portion 121 pivots with respect to the frame 110. If the quadrilateral is not a parallelogram, the angle of the inner surface of the contact portion 130 with respect to the vertical will vary somewhat as the lever portion 121 pivots, but due to the action of the four-bar linkage, the change in the angle of the inner surface can be can restrained to a significantly lower value than if the contact portion 130 were rigidly connected to the lever portion 121. In the present embodiment, each quadrilateral is a parallelogram, and each four-bar linkage is a parallel linkage which maintains the angle of the inner surface of the contact portion 130 constant as each clamping arm 120 pivots about its upper end. For example, the angle of the inner surface of each contact portion 130 is the same in FIG. 4, FIG. 5, and FIG. 6 even though the separation between the opposing contact portions 130 is different for each figure. Therefore, the contact portions 130 can be maintained at a suitable angle for grasping the sides of loads of various sizes.

A suitable angle of the inner surface of a contact portion 130 with respect to the side of a load to be grasped by the contact portion 130 depends upon the type of load. When the load comprises boxes of cookies, for example, the inner surface of each contact portion 130 is preferably approximately parallel to the side of the load when contacting the load. In this case, assuming that the side of the load is vertical, then the inner surface of the contact portion 130 is preferably close to vertical when contacting the load. When the load comprises cans of beverages, such as cans of soft drinks or beer, the inner surface is preferably sloped with respect to the side of the load by 2-6° and preferably by approximately 3°, with the inner surface of the contact portion 130 sloping downwards towards the side of the load. When the inner surface of the contact portion 130 slopes in this manner, it can more effectively grasp and support a load. An angle of slope in which the inner surface of the contact portion 130 slopes downwards towards a load is referred to here as a positive angle. It is preferred that the angle of the inner surface of the contact portions 130 with respect to the side of the load not be a negative value, i.e., that it not be an angle such that the inner surface slopes upwards towards the side of a load. The angle of the inner surface of the contact portion 130 with respect to the side of a load can be easily adjusted in accordance with the type or shape of the load by changing the length of one of the links of the four-bar linkage. For example, the angle of the inner surface of a contact portion 130 can be adjusted by varying the length of the corresponding control rod 140. In this embodiment, each control rod 140 has a midportion and a clevis 141 connected to each end of the midportion by a threaded connection. The length of the control rod 140 can be adjusted by rotating the midportion with respect to the clevises 141.

In addition to controlling the angle of the inner surface of the contact portion 130, the four-bar linkage defined by each clamping arm 120 can reduce the amount by which the height of the inner surface of the contact portion 130 varies as the clamping arm 120 pivots on the frame 110 compared to if the contact portion 130 were rigidly secured to the lever portion 121.

The number of lever portions 121 and control rods 140 with which each clamping arm 120 is equipped can be different from that shown in the drawings. For example, each clamping arm 120 could comprise two lever portions 121 and a single control rod 140 disposed between the lever portions 121.

Figure 4:
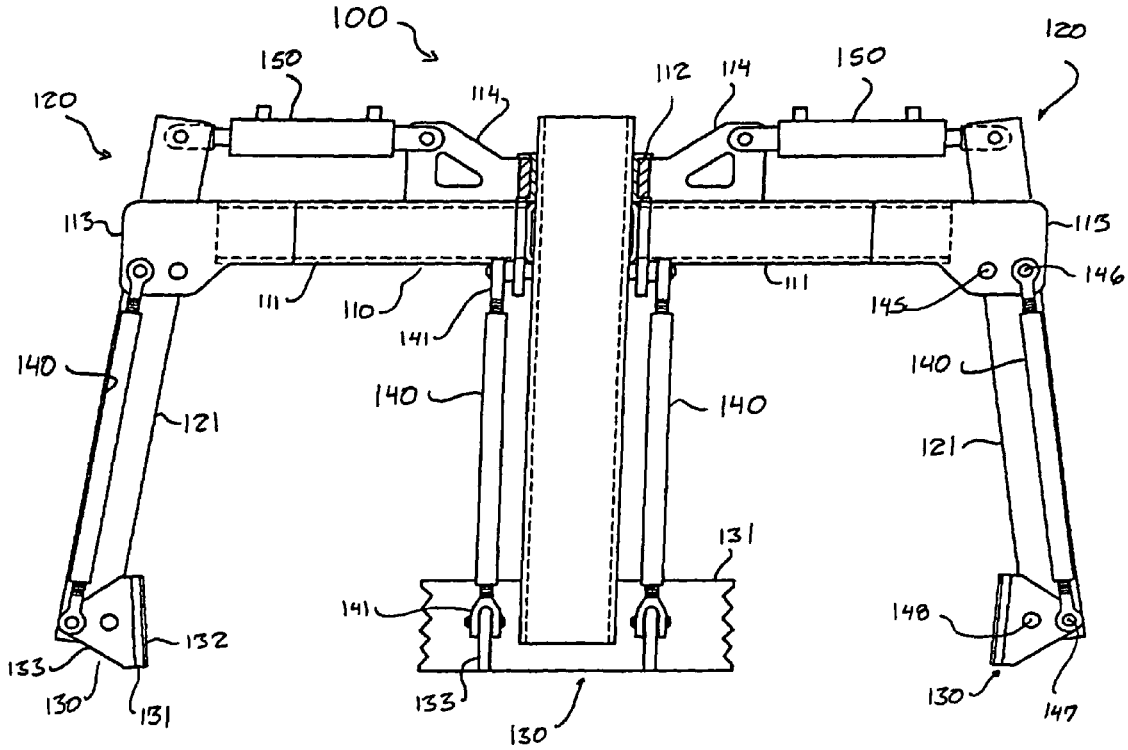
FIG. 4 is an elevation of another embodiment of a clamping apparatus according to the present invention with the opposing clamping arms of the apparatus separated by a first spacing.

The hydraulic cylinders 150 can be controlled so as to pivot the clamping arms 120 towards and away from each other to clamp or release a load. FIG. 4 shows opposing clamping arms 120 with a first spacing, such as might be employed when positioning the clamping arms 120 with respect to a load to be lifted. FIG. 5 shows opposing clamping arms 120 with a second spacing smaller than the first spacing at which the clamping arms 120 are contacting the sides of a load 155. FIG. 6 shows opposing clamping arms 120 with a third spacing smaller than the second spacing such as might be employed when grasping a small load or when the clamping apparatus 100 is being moved about so as to reduce the overall size of the clamping apparatus 100. Each hydraulic cylinder 150 may be separately supplied with hydraulic fluid so that the movement of the cylinder 150 will stop when the pressure of the contact portion 130 of the corresponding clamping arm 120 against a load being contacted reaches a certain level. Because the contact portions 130 maintain a constant angle to the vertical, the problem which is experienced with some existing clamping apparatuses of contact portions 130 of clamping arms 120 digging into the sides of a load due to variations in the angle of the contact portions 130 can be avoided.

The clamping apparatus 100 can be supported by a lift truck or other device in any suitable manner. For example, it may be equipped with a mounting bracket like the mounting bracket 24 shown in FIG. 1, or it may be equipped with a connector like that described below with respect to FIGS. 9-14.

FIGS. 9-14 illustrate another embodiment of a clamping apparatus 200 according to the present invention mounted on a lift truck 260. Like the previous embodiment, this embodiment of a clamping apparatus 200 includes a cross-shaped frame 210 having four horizontally extending legs 211 disposed at right angles to each other. Each of the illustrated legs 211 comprises a rectangular tube connected at its inner end to a vertically extending rectangular tube 215. The tube 215 can be used to slidably receive an unillustrated internal support member for reinforcing the inner walls of a cavity in a layer of objects to be lifted by the clamping apparatus 200, as described in U.S. Pat. No. 6,003,917. However, if a support member is not needed, the tube 215 can be omitted, and the legs 211 can be directly connected to each other at their inner ends. Stiffeners 216 may be provided between the legs 211 to give greater strength to the frame 210.

A clamping arm 220 is pivotably mounted on the outer end of each leg 211 of the frame 210. Each clamping arm 220 includes an elongated lever portion 221 and a contact portion 230 mounted on the lower end of the lever portion 221. In this embodiment, each lever portion 221 includes two parallel plates 222 disposed on opposite widthwise sides of one of the legs 211 of the frame 210 and pivotably connected to the leg 211 near the upper ends of the plates 222. As in the present embodiment, the axis of pivoting of the upper end of each lever portion 221 on the frame 210 is at the same distance from the center of the frame 210, but it is possible for this distance to vary among the clamping arms 220. The lower end of each plate 222 is secured to a sleeve 225 by which the lever portion 221 is pivotably connected to the contact portion 230. One or more drive mechanisms, such as hydraulic cylinders 250, are provided for pivoting each lever portion 221 with respect to the corresponding leg 211 about its axis of rotation. In the illustrated embodiment, a separate hydraulic cylinder 250 is provided for each clamping arm 220, with one end of the hydraulic cylinder 250 being pivotably connected to a bracket 213 extending upwards from one of the legs 211 of the frame 210 and the opposite end of the hydraulic cylinder 250 being pivotably connected to a bracket 223 secured to the two plates 222 of the corresponding lever portion 221 near their upper ends. When the hydraulic cylinders 250 are actuated, each lever portion 221 can pivot about the corresponding axis to adjust the separation between opposing contact portions 230 to enable the contact portions 230 to grasp or release an object. As is the case with respect to the previous embodiments, drive mechanisms other than hydraulic cylinders 250 can be employed, such as electric motors, hydraulic motors, or pneumatic cylinders.

Figure 9:
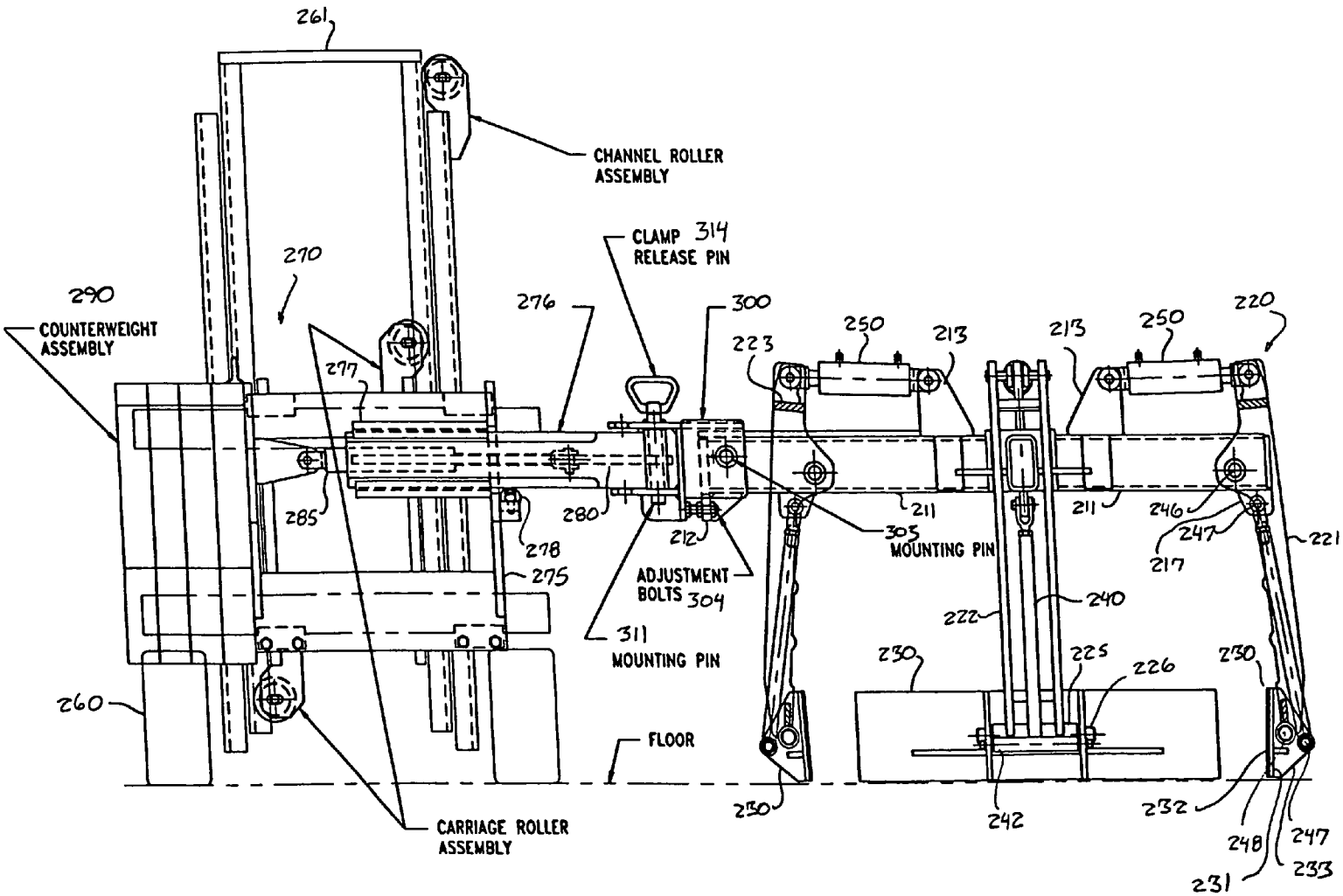
FIG. 9 is an elevation of another embodiment of a clamping apparatus according to the present invention mounted on a lift truck.

The contact portions 230 may have a structure similar to that of the contact portions of the previous embodiment. Each contact portion 230 includes a rigid elongated panel 231 and a resilient pad 232 of rubber or other suitable material on the inner surface of the panel 231 to provide cushioning and a good grip. A plurality of mounting lugs 233 are mounted on the outer surface of each panel 231. As shown in FIG. 9, the sleeve 225 at the lower end of the plates 222 of each lever portion 221 pivotably engages an axle 226 extending between the lugs 233 to provide a pivotable connection between the lever portion 221 and the contact portion 230.

Each clamping arm 220 also includes a control rod 240 extending alongside the lever portion 221. The load applied to the control rods 240 will typically be less than that applied to the lever portions 221, since in this embodiment a bending moment is applied by the hydraulic cylinders 250 only to the lever portions 221, so the control rods 240 can generally be of lighter construction than the lever portions 221. As in the preceding embodiment, the control rod 240 is preferably sufficiently stiff to prevent the contact portion 230 from rotating about the lower end of the lever portion 221 under forces applied to the contact portion 230 when it is pressed against the side of a load which is to be grasped by the clamping apparatus 200. The upper end of each control rod 240 is pivotably connected to a mounting bracket 217 mounted on the lower side of one of the legs 211 of the frame 210. The lower end of each control rod 240 is equipped with a sleeve 242 which pivotably engages an axle 243 extending between the mounting lugs 233 on the contact portion 230. When any of the clamping arms 220 is viewed from the side, such as in FIG. 9, the axis of rotation 245 of the lever portion 221 with respect to the frame 210, the axis of rotation 246 of the upper end of the control rod 240 with respect to the frame 210, the axis of rotation 247 of the lower end of the control rod 240 with respect to the mounting lugs 233 of the contact portion 230, and the axis of rotation 248 of the lower end of the lever portion 221 with respect to the mounting lugs 233 of the contact portion 230 lie at the four corners of a quadrilateral, and the lever portion 221, the control rod 240, the outer end of the leg 211 of the frame 210, and the mounting lugs 233 of the contact portion 230 define a four-bar linkage. The four-bar linkage functions to control the angle of the inner surface of the contact portion 230 with respect to the vertical as the lever portion 221 of the clamping arm 220 pivots about axis 245. If the quadrilateral is a parallelogram, the four-bar linkage becomes a parallel linkage, and the angle of the inner surface of the contact portion 230 with respect to the vertical remains constant as the lever portion 221 pivots about axis 245. If the quadrilateral is not a parallelogram, the angle of the inner surface of the contact portion 230 with respect to the vertical will vary as the lever portion 221 pivots, but due to the action of the four-bar linkage, the change in the angle of the inner surface can be restrained to a significantly lower value than if the contact portion 230 were rigidly connected to the lever portion 221. For example, in the present embodiment, even though the quadrilateral defined by the axes of rotation 245-248 visibly deviates from a parallelogram, rotation of the lever portion 221 in the clockwise direction from the position shown in FIG. 9 produces a very small change in the angle of the inner surface of the contact portion 230 with respect to the vertical.

In the food handling industry, food products are often stacked for shipment or storage in layers on pallets. The pallets typically measure 40×48 inches, and the layers typically have dimensions ranging from less than 30 inches to more than 50 inches on a side. Common dimensions of rectangular layers disposed on such pallets are 32×36 inches, 40×48 inches, and 28×38 inches. Thus, the length and the width of a rectangular layer on a pallet often differ from each other by a least 4 inches. In the present embodiment, the separation between the contact portions 230 of two opposing clamping arms 220 can preferably vary by at least 4 inches (such as by 4, 6, 8, or 10 or more inches) with the angle with respect to the vertical of the inner surfaces of the contact portions 230 thereof preferably varying by at most 2°. This enables the clamping apparatus 200 to grasp different loads having different dimensions, and it enables the clamping apparatus 200 to grasp rectangular layers like those described above with at most a 2° variation in the angles with respect to the vertical of the inner surfaces of the different contact portions 230. More preferably, the lower end of the contact portion 230 of each clamping arm 220 can travel by a horizontal distance of at least 6 inches and still more preferably by at least 8 inches as the clamping arm 220 pivots to grasp or release a load with at most a 2° variation in the angle of the inner surface of the contact portion 230 with respect to the vertical.

As a specific example of the angle of the contact portions 230 as the clamping arms 220 pivot, when the clamping arms 220 of this embodiment are in the position shown in FIG. 9, the separation between the lower ends of the opposing contact portions 230 is 43 inches, and the angle of the inner surface of each contact portion 230 with respect to the vertical (assuming that the frame 210 is level) is approximately 2.6°. If each clamping arm 220 is rotated about the frame 210 by 20° towards the opposing clamping arm 210 (in the clockwise direction for the righthand clamping arm 210 and in the counterclockwise direction for the lefthand clamping arm 210), the separation between the lower ends of the opposing contact portions 230 becomes approximately 26.6 inches, and the angle of the inner surface of each contact portion 230 with respect to the vertical becomes approximately 1.9°. In this range of rotation, in which the lower end of each contact portion 230 travels horizontally by approximately 8.2 inches and the separation between the inner surface of the opposing contact portions 230 varies by approximately 16.4 inches, the angle of the inner surface of each contact portion 230 varies between a maximum value of approximately 3.3° and a minimum value of approximately 1.9° for a maximum variation of approximately 1.4°.

The amount of variation in the angle of the inner surfaces of the contact portions 230 with respect to the vertical is not a constant function of the amount of variation in the separation between opposing contact portions 230. When the separation between the contact portions 230 of FIG. 9 varies by 4 inches from approximately 26.6 inches to approximately 30.6 inches, the angle of each inner surface varies by approximately 0.9°, whereas when the separation between the contact portions 230 varies by 4 inches from approximately 34 inches to approximately 38 inches, the angle of each inner surface varies hardly at all (by less than)0.1°. Therefore, even though the four-bar linkage defined by the clamping arm 220 is not a parallel linkage, in some operating ranges, it can maintain the angle with respect to the vertical of the inner surface of the contact portion 230 substantially constant as the clamping arm 220 pivots.

As is the case with respect to the preceding embodiment, the four-bar linkage defined by each clamping arm 220 can also reduce the amount by which the height of the inner surface of the contact portion 230 varies as the clamping arm 220 pivots on the frame 210 compared to if the contact portion 230 were rigidly secured to the lever portion 221.

As in the preceding embodiment, the angle with respect to the vertical of the inner surface of each contact portion 230 can be set to a desired value in accordance with the nature or shape of the load to be grasped by varying the length of some portion of the four-bar linkage defined by the clamping arm 220, such as the control rod 240. In this embodiment, the upper end of each control rod 240 has a clevis 241 connected to the body of the control rod 240 by a threaded connection. The clevis 241 can be rotated with respect to the body to adjust the length of the control rod 240.

The hydraulic cylinders 250 can be controlled in the same manner as in the preceding embodiment to pivot the clamping arms 220 towards and away from each other to grasp or release an object.

The maximum and minimum dimensions of a load which can be grasped by the clamping apparatus 200 will depend upon the maximum and minimum separation between the contact portions 230 of opposing clamping arms 200. The clamping apparatus 200 can be easily modified to handle a larger or smaller load by lengthening or shortening the legs 211 of the frame 210 without it being necessary to otherwise modify the clamping apparatus 200. It is also possible to change the maximum and minimum separation between the contact portions 230 by changing the stroke of the hydraulic cylinders 250 or the lengths of the clamping arms 220, but it is usually easier to change only the size of the frame 210, in which case the same clamping arms 220 and hydraulic cylinders 250 can be used on frames 210 of different sizes.

As stated earlier, a clamping apparatus according to the present invention can be supported in any convenient manner by any suitable device, but it is particularly suitable for use with a lift truck. FIGS. 9-13 illustrate one manner of mounting the clamping apparatus 200 on a lift truck 260. The illustrated lift truck 260 is equipped with a side shifter 270 which supports the clamping apparatus 200 so as to be able to translate the clamping apparatus 200 with respect to the lift truck 260 in the widthwise direction of the lift truck 260 to adjust the position of the clamping apparatus 200 with respect to a load. The side shifter 270 includes a frame 275 which is supported on the mast 261 of the lift truck 260 and can move along the mast 261 on rollers as it is raised and lowered to a desired height. A counterweight 290 can be mounted on the side of the frame 275 remote from the clamping apparatus 200 to counterbalance the weight of the clamping apparatus 200. The frame 275 movably supports a lateral support member comprising a beam 276 for linear movement with respect to the lift truck 260 in the widthwise direction of the lift truck 260. The beam 276 is slidably received by a plurality of horizontal guide rails 277 secured to the frame 275, and the beam 276 is additionally supported by a roller 278 mounted on the frame 275 beneath the beam 276. The beam 276 includes a horizontal flange 280 extending along its length. The beam 276 can be translated in its lengthwise direction by any suitable drive mechanism, which in the present embodiment is a hydraulic cylinder 285 connected between the frame 275 and the flange 280.

The outer end of the beam 276 is connected to the clamping apparatus 200 by a connector 300 which enables the angle of the clamping apparatus 200 with respect to the lift truck 260 to be adjusted with two degrees of freedom. As shown in FIGS. 11-14, the connector 300 includes an upright central plate 301 defining a central wall and a pair of side plates 302 extending parallel to each other from the central plate 301 and defining side walls. The outer end of one of the legs 211 of the frame 210 of the clamping apparatus 200 is pivotably connected to the side plates 302 by a mounting pin 303 extending between the side plates 302. The leg 211 which is connected to the connector 300 may be longer than the other legs 211 of the frame 210 in order to prevent interference with the movement of the clamping arms 220. A vertical flange 212 is secured to the outer end of the leg 211 which is connected to the connector 300. The flange 212 has one or more openings, such as holes or slots, each of which loosely engages with a corresponding adjustment bolt 304 extending from the central plate 301 towards the clamping apparatus 200. Each adjustment bolt 304 is equipped with two nuts 305 which are screwed onto the adjustment bolt 304 on opposite sides of the flange 212. When the nuts 305 are loosened with respect to the flange 212, the clamping apparatus 200 can be pivoted with respect to the lift truck 260 about the axis of the mounting pin 303 to a desired angle with respect to the horizontal, and then the nuts 305 can be tightened to maintain the clamping apparatus 200 at this angle.

It is generally desirable for the frame 210 of the clamping apparatus 200 to be parallel to the support surface on which a load is disposed during use so that all the contact portions 230 of the clamping arms 220 are at the same height as each other relative to the support surface. When the surface on which the lift truck 260 is operating is not parallel to the surface on which the load is supported, the angle of the mast 261 of the lift truck 260 with respect to the vertical can be adjusted by pivoting the mast 261 in the fore-and-aft direction of the lift truck 260 until the axis of the mounting pin 303 is parallel to the surface on which the load is supported, and the clamping apparatus 200 can be pivoted about the mounting pin 303 to adjust the angle of the frame 210 with respect to the horizontal until the frame 210 of the clamping apparatus 200 is parallel to the surface on which the load is supported. Thus, the ability of the clamping apparatus 200 to be pivoted about the mounting pin 303 makes it possible to compensate for slopes or unevenness in either the surface on which the lift truck 260 is supported or the surface on which the load is supported.

Figure 10:
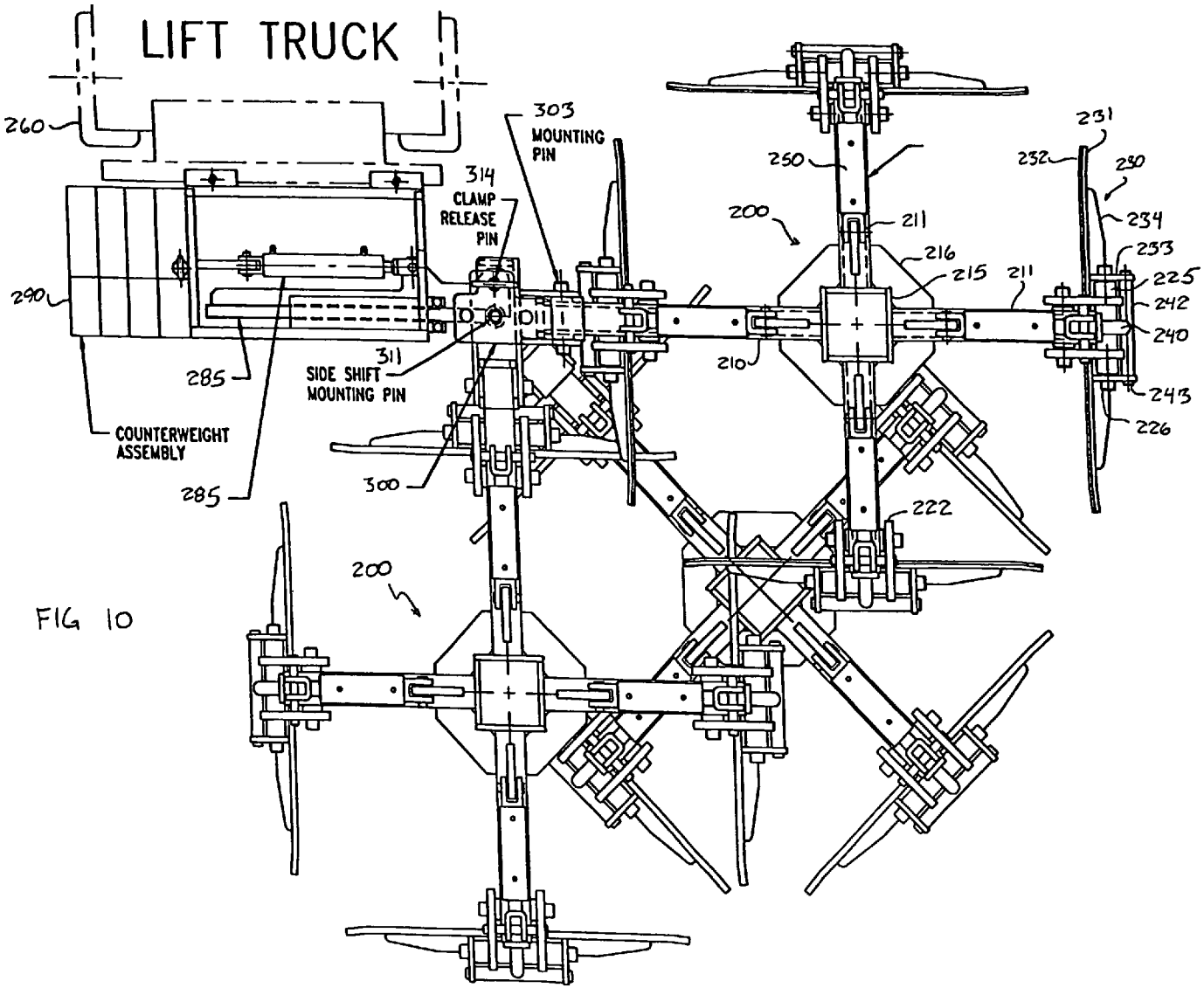
FIG. 10 is a plan view of the embodiment of FIG. 9.
Figure 11:
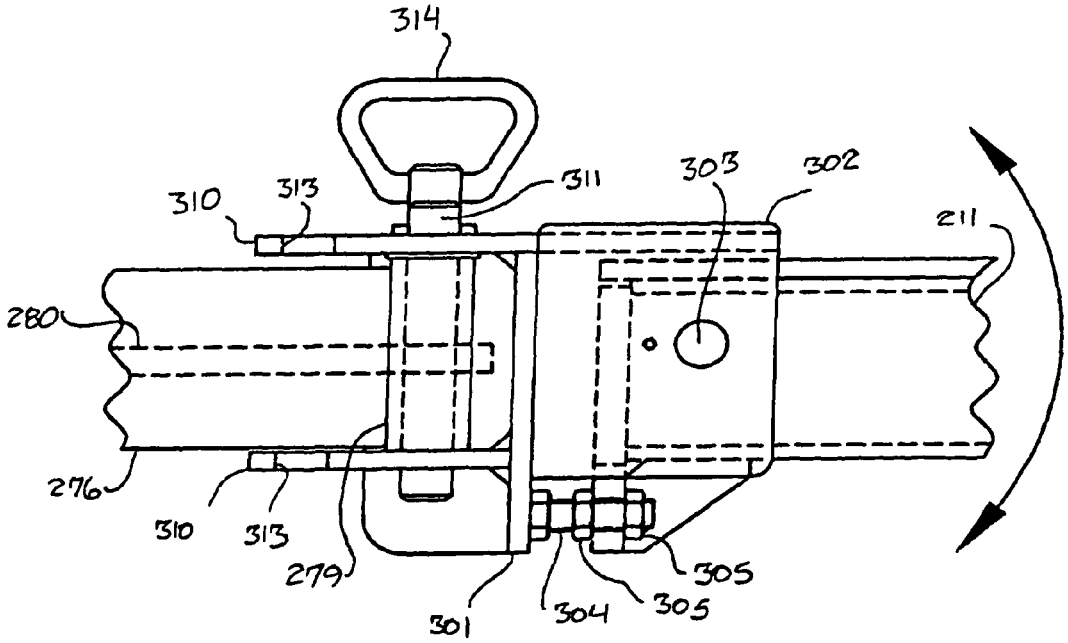
FIG. 11 is an enlarged elevation of a connector for use with the embodiment of FIG. 9.
Figure 12:
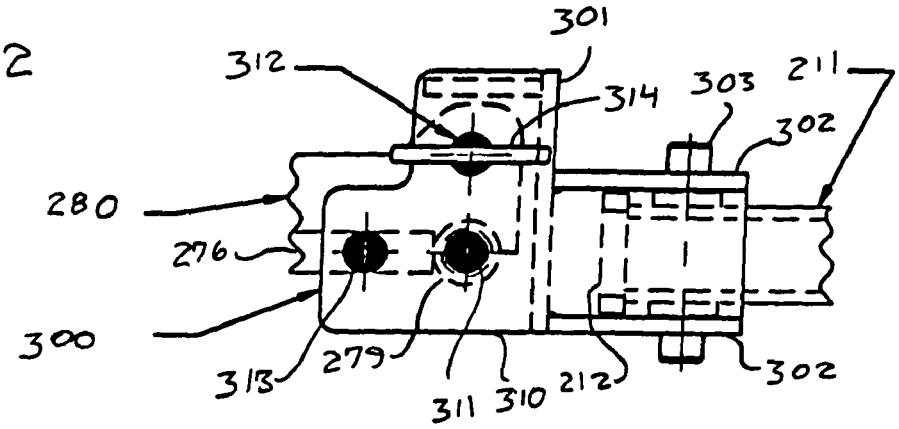
FIGS. 12-14 are enlarged plan views of the connector of FIG. 11 in different rotational positions.
Figure 13:
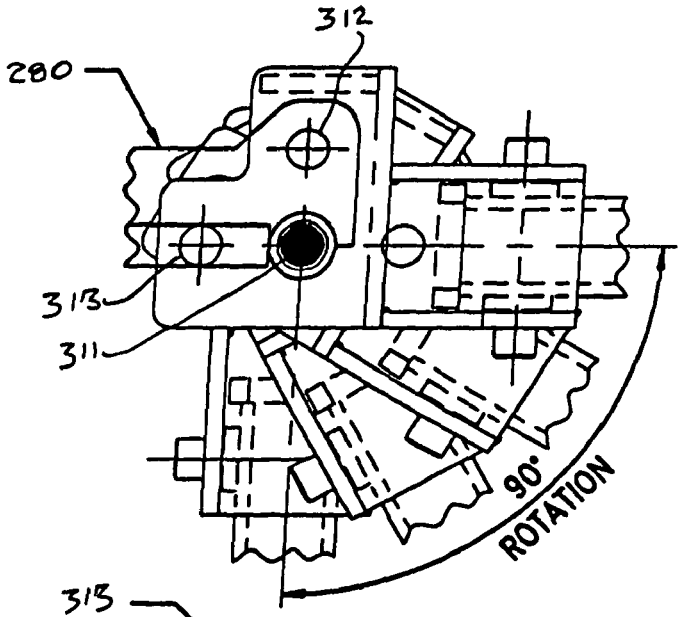
Figure 14:
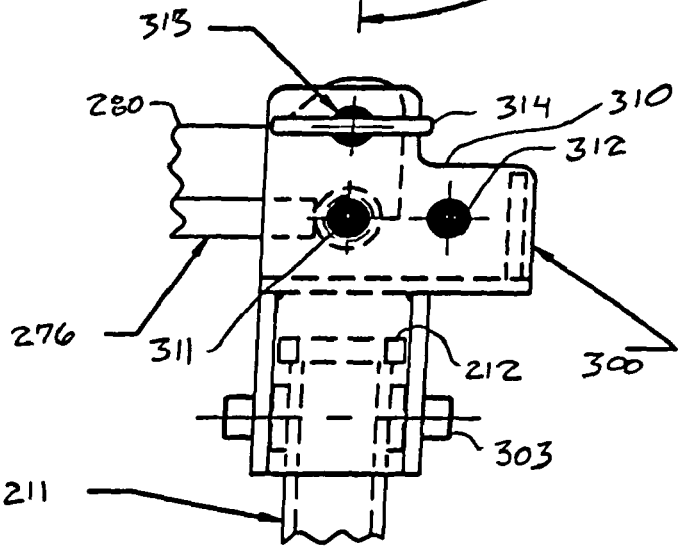

The connector 300 also enables the clamping apparatus 200 to be pivoted about a generally vertical axis to adjust the position of the clamping apparatus 200 with respect to the lift truck 260 in the widthwise direction of the lift truck 260. In the present embodiment, as shown in FIG. 10, the clamping apparatus 200 can be pivoted between first and second positions spaced 90° apart from each other as measured about a vertical axis. In the first position, the leg 211 of the frame 210 to which the connector 300 is connected extends in the widthwise direction of the lift truck 260 in alignment with the beam 276 of the side shifter 270, and the clamping arms 220 of the clamping apparatus 200 (and therefore any load grasped by the clamping arms 220) are disposed outboard of the axis of pivoting, i.e., farther from the lift truck 260 than is the axis of pivoting in the widthwise direction of the lift truck 260. In the second position, this leg 211 extends in the fore-and-aft direction of the lift truck 260, and the clamping arms 220 of the clamping apparatus 200 (and any load grasped by the clamping arms 220) are disposed forward of the axis of pivoting in the fore-and-aft direction of the lift truck 260.

When the lift truck 260 is being operated alongside a row of pallets, the clamping apparatus 200 will typically be in the first position. When the clamping apparatus 200 needs to be inserted through a narrow opening, such as through the doors of a cold storage compartment, the clamping apparatus 200 can be pivoted to its second position to make the clamping apparatus 200 easier to manipulate and to reduce the overall width of the lift truck 260 and the clamping apparatus 200. The second position of the clamping apparatus 200 is also convenient when the lift truck 260 needs to travel from one location to another within a factory, or when the lift truck 260 with the clamping apparatus 200 attached to it is being transported inside a trailer and it is desirable to reduce the extent to which the clamping apparatus 200 extends outwards from the lift truck 260 in the widthwise direction thereof. The clamping apparatus 200 can operate to grasp and release an object when in either its first or second position.

As shown in FIGS. 11-14, the connector 300 includes upper and lower plates 310 defining walls extending one above the other from the central plate 301. The upper and lower plates 310 are pivotably connected to the beam 276 of the side shifter 270 by a pin 311 passing through a sleeve 279 secured to the outer end of the beam 276. Each of the upper and lower plates 310 has two engaging portions comprising holes 312 and 313 formed therein and spaced 90° from each other as measured from the center of the mounting pin 311. The flange 280 of the beam 276 likewise has an engaging portion comprising an unillustrated hole formed therein and positioned below hole 312 in FIG. 12. When the clamping apparatus 200 is in its first position shown in FIG. 12, holes 312 in the upper and lower plates 310 are aligned with the hole in the flange 280 of the beam 276, and when the clamping apparatus 200 is in its second position shown in FIG. 14, holes 313 in the upper and lower plates 310 are aligned with the hole in the flange 280. The clamping apparatus 200 can be retained in its first or second position by a removable clamp release pin 314 which passes through the hole in the flange 280 and whichever of the holes 312 or 313 in the upper and lower plates 310 are aligned with the hole in the flange 280. The clamp release pin 314 may be equipped with structure for preventing the pin 314 from accidentally disengaging from the holes, such as a cotter pin or spring-loaded detent balls. If the upper and lower plates 310 are provided with more holes in addition to holes 312 and 313, the clamping apparatus 200 can retained in further rotational positions in addition to the first and second positions.

A lift truck 260 or other member for supporting a clamping apparatus 200 according to the present invention need not be equipped with a side shifter 270. For example, the clamping apparatus 200 can be supported by a beam or other lateral support member which is supported by the mast 261 of the lift truck 260 so as to be capable of being raised or lowered but which does not translate with respect to the lift truck 260 in the widthwise direction of the lift truck 260. In this case as well, a connector 300 like that shown in the figures can be conveniently employed to connect the clamping apparatus 200 to the member which supports it.

In this embodiment, the clamping apparatus 200 can be manually pivoted about the mounting pin 311 between its first and second positions. However, an actuator can be provided to pivot the clamping apparatus 200 about the mounting pin 311. For example, a hydraulic cylinder can be connected between the front of the frame 275 of the side shifter 270 and one of the upper and lower plates 310 of the connector 300, and the connector 300 can be rotated with respect to the beam 276 of the side shifter 270 about the axis of the mounting pin 311 by operation of the hydraulic cylinder.

The connector 300 shown in FIGS. 9-14 is not limited to use with any particular type of clamping apparatus. For example, it can also be used with either of the clamping apparatuses shown in FIGS. 1-8 or with any other type of clamping apparatus for mounting on a lift truck or any other support device.

What is claimed is:

1. A clamping apparatus for lifting a rectangular layer of items on a pallet comprising:

a frame;

four clamping arms pivotably mounted on the frame for pivoting with respect to the frame with a single degree of freedom and positioned on the frame so as to be able to grasp a rectangular layer of items on a pallet from four sides of the layer, each clamping arm including a contact portion for contacting a side of the layer to be lifted, each clamping arm defining a four-bar linkage which controls an angle of the contact portion with respect to the vertical as the clamping arm pivots with respect to the frame, wherein the four-bar linkage of each clamping arm includes a lever portion which is pivotably connected to the contact portion of the clamping arm and which is pivotably supported by the frame for pivoting with a single degree of freedom about a pivot point which is fixed with respect to the frame and a rigid control rod which extends alongside the lever portion and which has an upper end which is pivotably supported by the frame for pivoting with a single degree of freedom about a pivot point which is fixed with respect to the frame and a lower end pivotable with respect to the contact portion, the contact portion includes an elongated rigid plate-shaped panel having a front upright surface for opposing a side of the layer of items to be lifted and a plurality of mounting lugs secured to a back upright surface of the panel and pivotably connected to a lower end of the lever portion and a lower end of the control rod, the control rod is pivotable about a first axis with respect to the frame and about a second axis with respect to the contact portion, the first and second axes being parallel to each other and spaced from each other in a lengthwise direction of the control rod, and it is possible to draw a line which is parallel to the first and second axes and passes through the control rod and the lever portion of the clamping arm; and a plurality of drive mechanisms connected to the clamping arms to pivot the clamping arms with respect to the frame, each drive mechanism applying a torque to one of the lever portions to pivot the lever portion with respect to the frame.

2. A clamping apparatus as claimed in claim 1 wherein the lever portion of each four-bar linkage extends above the frame, and each drive mechanism is disposed above the frame and is pivotably connected to one of the lever portions above the frame.

3. A clamping apparatus as claimed in claim 1 wherein the lever portion and the control rod of each clamping arm move in parallel planes which are spaced from each other when the clamping arm pivots with respect to the frame.

4. A clamping apparatus for lifting a rectangular layer of items on a pallet comprising:

a frame;

four clamping arms pivotably mounted on the frame for pivoting with respect to the frame with a single degree of freedom and positioned on the frame so as to be able to grasp a rectangular layer of items on a pallet from four sides of the layer, each clamping arm including a contact portion for contacting a side of the layer to be lifted, each clamping arm defining a four-bar linkage which controls an angle of the contact portion with respect to the vertical as the clamping arm pivots with respect to the frame wherein the four-bar linkage of each clamping arm includes a lever portion which is pivotably connected to the contact portion of the clamping arm and which is pivotably supported by the frame for pivoting with a single degree of freedom about a pivot point which is fixed with respect to the frame and a rigid control rod which extends alongside the lever portion and which has an upper end which is pivotably supported by the frame for pivoting with a single degree of freedom about a pivot point which is fixed with respect to the frame and a lower end pivotable with respect to the contact portion, the contact portion includes an elongated rigid plate-shaped panel having a front upright surface for opposing a side of the layer of items to be lifted and a plurality of mounting lugs secured to a back upright surface of the panel and pivotably connected to a lower end of the lever portion and a lower end of the control rod, the lever portion has upper and lower axes of pivoting and the control arm has upper and lower axes pivoting, and a plane which contains the lower axis of pivoting of the lever portion and the lower axis of pivoting of the control rod passes through a region of the contact portion which contacts a side of the layer to be lifted; and a plurality of drive mechanisms connected to the clamping arms to pivot the clamping arms with respect to the frame, each drive mechanism applying a torque to one of the lever portions to pivot the lever portion with respect to the frame.

* * * * *

UNITED STATES PATENT AND TRADEMARK OFFICE

CERTIFICATE OF CORRECTION

PATENT NO. : 8,142,131 B2
APPLICATION NO. : 12/453441
DATED : March 27, 2012
INVENTOR(S) : Edward Tygard It is certified that error appears in the above-identified patent and that said Letters Patent is hereby corrected as shown below:

Column 13, line 53 (claim 1, line 18), change “to the frame and” to --to the frame, and--.

Column 14, line 34 (claim 4, line 12), change “to the frame” to --to the frame,--.

Column 14, line 40 (claim 4, line 18), change “to the frame and” to --to the frame, and--.

Column 14, line 53 (claim 4, line 31), change “control arm” to --control rod--.

Signed and Sealed this
Twenty-eighth Day of August, 2012

David J. Kappos

David J. Kappos
*Director of the United States Patent and Trademark Office*